US011627813B2

(12) United States Patent
Nguyen

(10) Patent No.: US 11,627,813 B2
(45) Date of Patent: Apr. 18, 2023

(54) MULTIPLE ZONE MATTRESS CORE ELEMENT WITH MULTIPLE COIL CONFIGURATIONS

(71) Applicant: Avocado Green Brands, LLC, Fullerton, CA (US)

(72) Inventor: Vy Nguyen, Fullerton, CA (US)

(73) Assignee: Avocado Green Brands, LLC, Fullerton, CA (US)

( * ) Notice: Subject to any disclaimer, the term of this patent is extended or adjusted under 35 U.S.C. 154(b) by 0 days.

(21) Appl. No.: 17/189,658

(22) Filed: Mar. 2, 2021

(65) Prior Publication Data

US 2022/0279934 A1 Sep. 8, 2022

(51) Int. Cl.
*A47C 27/06* (2006.01)

(52) U.S. Cl.
CPC ..... *A47C 27/062* (2013.01); *A47C 27/064* (2013.01)

(58) Field of Classification Search
CPC ..... Y10T 29/48; A47C 27/062; A47C 27/064
See application file for complete search history.

(56) References Cited

U.S. PATENT DOCUMENTS 5,987,678 A * 11/1999 Ayers ..... A47C 27/064 5/655.8
6,353,952 B1 * 3/2002 Wells ..... A47C 31/123 5/717
6,668,406 B2 * 12/2003 Spinks ..... A47C 27/064 5/655.8
6,807,698 B2 * 10/2004 Torbet ..... A47C 27/082 5/730
6,898,813 B2 * 5/2005 Grothaus ..... A47C 27/062 5/655.8
6,966,091 B2 * 11/2005 Barber ..... F16F 1/08 267/89
7,992,242 B2 * 8/2011 Antinori ..... A47C 23/0522 5/717
8,978,183 B1 * 3/2015 Richmond ..... A47C 27/062 5/655.8
9,867,475 B2 * 1/2018 Kulju ..... A47C 27/15
10,104,970 B1 * 10/2018 Stiles ..... A47C 7/34
10,206,515 B1 * 2/2019 Jewett ..... A47C 27/056
11,412,861 B1 * 8/2022 Antinori ..... A47C 27/064
2004/0103479 A1 * 6/2004 Mossbeck ..... A47C 27/062 5/655.8
2004/0128773 A1 * 7/2004 Barber ..... F16F 1/08 5/716
2004/0172767 A1 * 9/2004 Mossbeck ..... A47C 27/064 5/721
2005/0257323 A1 * 11/2005 Edling ..... A47C 27/064 5/716
2005/0273939 A1 * 12/2005 Mossbeck ..... A47C 27/061 5/716

(Continued)

*Primary Examiner* — Michael W Hotchkiss
(74) *Attorney, Agent, or Firm* — The Kline Law Firm; Keith Kline

(57) ABSTRACT

This disclosure addresses mattresses. The mattress includes a core made up of multiple zones. Each of the zones includes a plurality of core elements, the core elements being formed from at least one wire coil spring at least partially contained in a fabric pouch. The core elements are typically joined in linear chains. The zones vary in support firmness according to the selection of a user. The core elements include wire coil springs formed from wires of at least two different sizes, and of at least two different heights.

3 Claims, 4 Drawing Sheets

(56) References Cited

U.S. PATENT DOCUMENTS

| | | | | |
|---|---|---|---|---|
| 2010/0257675 | A1* | 10/2010 | DeMoss | A47C 27/065 5/716 |
| 2011/0010249 | A1* | 1/2011 | Oexman | G06Q 30/0269 705/14.66 |
| 2011/0148018 | A1* | 6/2011 | DeFranks | A47C 23/0438 267/166.1 |
| 2013/0232699 | A1* | 9/2013 | Hinshaw | A47C 27/064 5/717 |
| 2015/0305514 | A1* | 10/2015 | Kulju | A47C 27/15 5/727 |
| 2016/0029809 | A1* | 2/2016 | Shive | A47C 27/05 5/718 |
| 2016/0213159 | A1* | 7/2016 | Eigenmann | A47C 21/042 |
| 2016/0227938 | A1* | 8/2016 | Pennington | A47C 27/07 |
| 2017/0354267 | A1* | 12/2017 | Alletto, Jr. | F16F 3/04 |
| 2018/0255937 | A1* | 9/2018 | Longman | A47C 27/061 |
| 2019/0380502 | A1* | 12/2019 | Eigenmann | B68G 9/00 |
| 2020/0037778 | A1* | 2/2020 | Jewett | A47C 27/064 |
| 2020/0229609 | A1* | 7/2020 | Warner | A47C 27/07 |

* cited by examiner

MULTIPLE ZONE MATTRESS CORE ELEMENT WITH MULTIPLE COIL CONFIGURATIONS

CROSS REFERENCE TO RELATED APPLICATIONS

N/A

FIELD OF THE DISCLOSURE

The present disclosure relates generally to mattresses and more particularly is a mattress core with multiple zones, each of which may be formed with coils having differing configurations.

SUMMARY

In various embodiments of the present disclosure, a mattress device includes a a core with a plurality of zones. Each of the zones is constructed with a plurality of core elements. The core elements have at least one wire coil spring which is at least partially contained in a fabric pouch. Typically, the core elements are joined together in a chain type configuration. A mattress cover encloses and secures the core elements to form a unitary mattress.

The zones may vary in support firmness according to the selection of a user. In some embodiments, the core element includes seven zones—a pair of side zones, a pair of end zones, a head support zone, a foot support zone, and a central trunk support zone.

The core elements include wire coil springs formed from wires. In most embodiments, the core elements include wire coil springs of at least two different sizes gauge ratings (thicknesses). The core elements may also include wire coil springs of differing heights.

BRIEF DESCRIPTION OF THE DRAWINGS

The accompanying drawings, wherein like reference numerals refer to identical or functionally similar elements throughout the separate views, together with the detailed description below, illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

The present disclosure is directed to configurations of coil cores used in mattresses. The construction utilizes multiple zones, each zone having a varying pre-selected set of characteristics that conform to the zones of a user's body.

Figure 1:
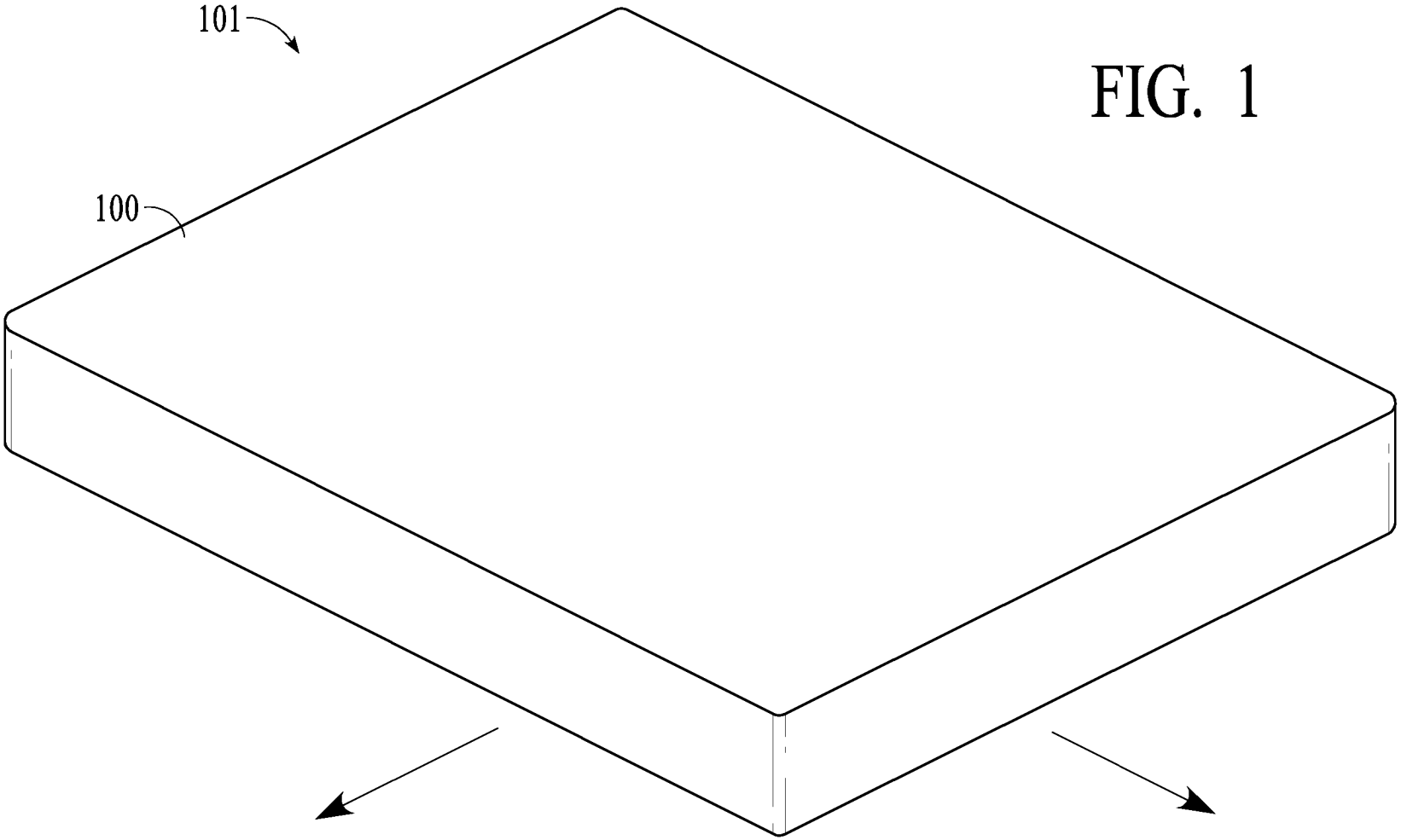
FIG. 1 is a top perspective view of a mattress utilizing a multiple zone coil core element.
Figure 2:
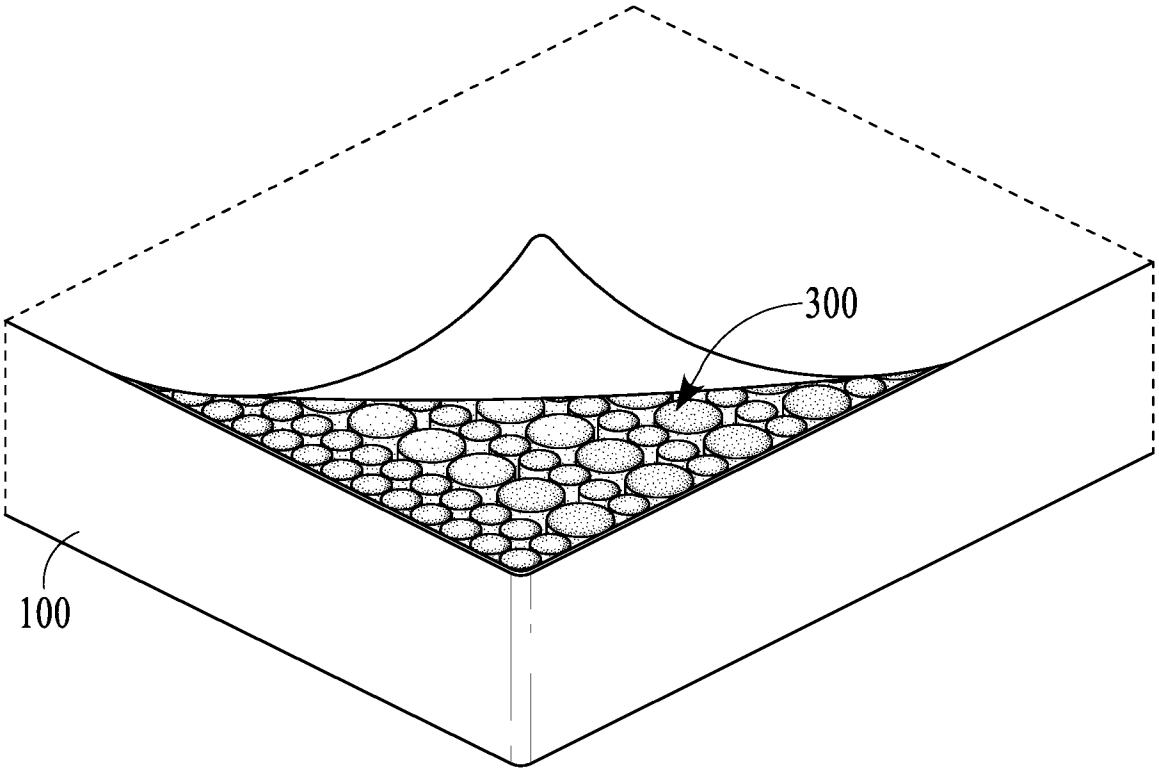
FIG. 2 is a top perspective view of a mattress with a cover partially opened to show the traditional employment of the multiple zone coil core element.

FIGS. 1 and 2 illustrate the deployment of a mattress core 300 (shown in FIG. 3) in a mattress cover 100 to form a unitary mattress 101. The mattress core 300 includes a plurality of zones, each zone having differing characteristics of firmness and support. In various embodiments of the present invention, the mattress core 300 includes seven distinct zones.

Figure 3:
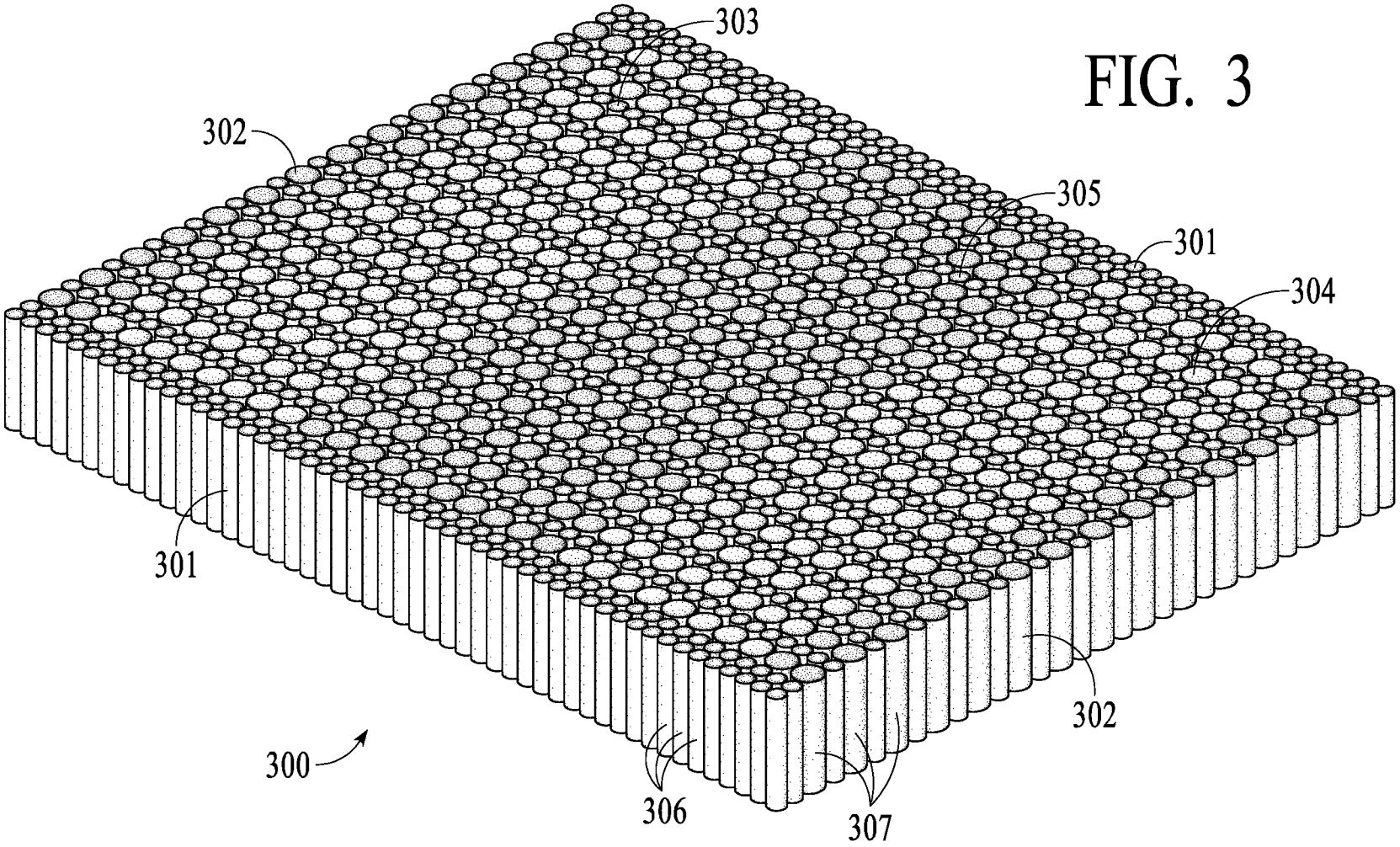
FIG. 3 is a is a top perspective view of the multiple zone coil core element.

Referring now to FIG. 3, the mattress core 300 may include a pair of side zones 301, a pair of end zones 302, a head support zone 303, a foot support zone 304, and a central trunk support zone 305. Other zones and configurations for the mattress core can be defined according to the requirements of a given embodiment.

As can be seen in the embodiment shown in FIG. 3, the mattress core 300 is formed from a plurality of coil elements 306, 307. The coil elements 306, which have a smaller diameter than core elements 307, are termed pencil coils 306. The larger coil elements 307 are interspersed with the pencil coils in various configurations. The coil elements 306, 307 are typically formed with inner wire core springs enclosed in fabric.

Figure 4:
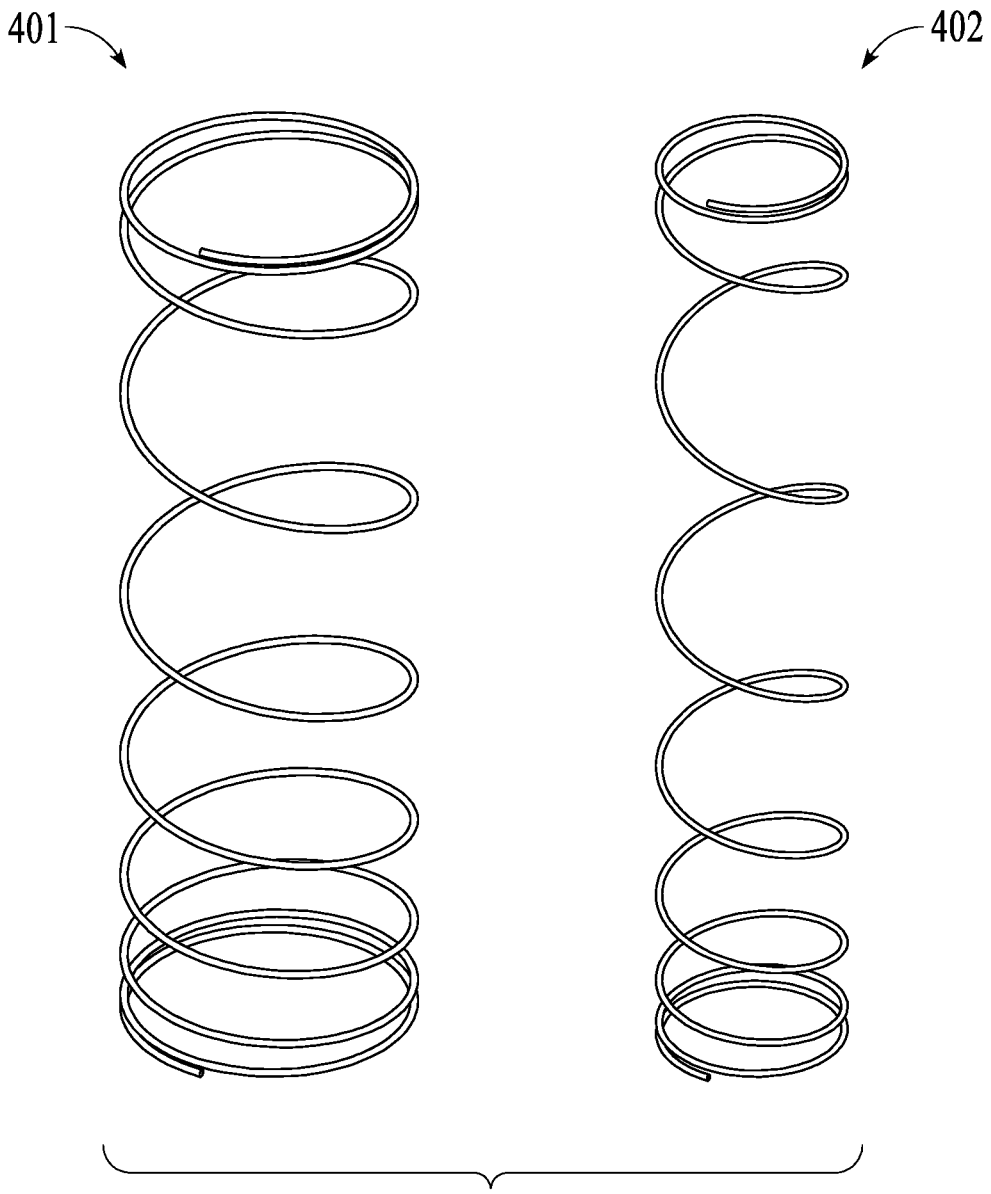
FIG. 4 is a top view of the core element.

The coil elements 306, 307 include central wire coil springs 401, 402 as illustrated in FIG. 4. The thickness of the wire coil springs 401, 402, can vary according to the design considerations of the user. These considerations include the mattress characteristics desired by the user, and may vary from one implementation to another. If a greater stiffness is desired for any of the coil elements 306, 307 utilized in a given zone of the mattress core 300, the wire core springs 401, 402 forming the coils in that zone are formed with greater wire thicknesses. Similarly, greater support in a given area can be obtained by utilizing the pencil coils 306 as opposed to the larger coils 307, the smaller diameters of the pencil coils 306 allowing for a denser pattern of coils. By varying the use of pencil coils 306 and the wider coils 307, a user can control with great specificity the characteristics of the resultant mattress.

The characteristics of a mattress built with coil elements 306, 307 can be further controlled by varying the length of the coil elements 306, 307. In many embodiments, the pencil coils 306 are slightly longer than the larger coils 307. The pencil coils 306 may be installed so that they extend above the surface formed by the larger coils 307. This gives the mattress greater firmness, and provides greater comfort and a means for increasing airflow across the surface of the mattress 101.

In most preferred embodiments, the wire coils springs 401, 402 are enclosed in fabric to form coils 306, 307, and are joined together in strings as shown in FIG. 3. This structure greatly facilitates manufacturing, and ensures the comfort of the end users.

Referring now again to FIG. 3, as mentioned above in various embodiments the mattress includes seven zones. The two side zones 301 are formed from multiple rows of pencil coils 306. The two end zones 302 are made with alternating pencil 306 and larger coils 307. The head support zone 303 and the foot support zone 304 are typically not required to be as stiff as other areas of the mattress core 300. As such, the wire coil springs utilized in the head and foot support zones 303, 304 may be made with a relatively light wire. Conversely, the trunk support zone 305 is generally desired to have the most support, and therefore heavier gauge wire may be utilized in the wire coil springs in the trunk support zone 305.

The technology disclosed herein addresses improved mattress core configurations. The improvements disclosed are independent of the actual materials used.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

In the foregoing description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A mattress device, comprising: a core comprising a plurality of zones, each of the plurality of zones comprising a plurality of core elements, each of the plurality of core elements comprising at least one wire coil spring at least partially contained in a fabric pouch, a pair of side zones are formed from multiple rows of pencil wire coil springs, a pair of end zones are formed with alternating pencil and larger wire coil springs, a head support zone and a foot support zone are formed with wire coil springs comprising light wire, and a trunk support zone formed from wire coil springs heavier than those of the head support zone and foot support zone; wherein the pencil wire coil springs have a smaller diameter than the larger wire coil springs and are longer than the larger wire coil springs; a mattress cover to enclose and secure the core; wherein a first core element of the plurality of core elements extends above a surface of a second core element of the plurality of core elements within a same zone of the plurality of zones of the mattress device, and wherein at least two of the plurality of zones vary in support firmness from one another, according to a selection of a user.

2. A multi-zone core adapted to be used in a mattress, comprising: a plurality of zones, each of the plurality of zones comprising a plurality of core elements, each of the plurality of core elements comprising at least one wire coil spring at least partially contained in a fabric pouch, a pair of side zones are formed from multiple rows of pencil wire coil springs, a pair of end zones are formed with alternating pencil and larger wire coil springs, a head support zone and a foot support zone are formed with wire coil springs comprising light wire, and a trunk support zone formed from wire coil springs heavier than those of the head support zone and foot support zone; wherein the pencil wire coil springs have a smaller diameter than the larger wire coil springs and are longer than the larger wire coil springs, wherein a first core element of the plurality of core elements extends above a surface of a second core element of the plurality of core elements within a same zone of the plurality of zones of the multi-zone core; and wherein at least two of the plurality of zones vary in support firmness from one another, according to a selection of a user.

3. A mattress device, comprising: a core comprising a plurality of zones, wherein at least two of the plurality of zones vary in support firmness from one another, according to a selection of a user; a plurality of core elements disposed within each zone of the plurality of zones; at least one wire coil spring at least partially contained in a fabric pouch in each of the plurality of core elements, a pair of side zones are formed from multiple rows of pencil wire coil springs, a pair of end zones are formed with alternating pencil and larger wire coil springs, a head support zone and a foot support zone are formed with wire coil springs comprising light wire, and a trunk support zone formed from wire coil springs heavier than those of the head support zone and foot support zone; wherein the pencil wire coil springs have a smaller diameter than the larger wire coil springs and are longer than the larger wire coil springs, wherein a first core element of the plurality of core elements extends above a surface of a second core element of the plurality of core elements within a same zone of the plurality of zones of the mattress device; wherein the plurality of core elements comprise wire coil springs formed from wires of at least two different thicknesses and a mattress cover to enclose and secure the core.

* * * * *